US006938278B2

(12) United States Patent
Parks et al.

(10) Patent No.: US 6,938,278 B2
(45) Date of Patent: Sep. 6, 2005

(54) CLIP-ON TRAINING URINAL

(76) Inventors: Russell Parks, 10 Wise Farm La., Ravenna, KY (US) 40472; Montie Parks, 165 Parks Country La., Ravenna, KY (US) 40472; Lynda Parks, 165 Parks Country La., Ravenna, KY (US) 40472

( * ) Notice: Subject to any disclaimer, the term of this patent is extended or adjusted under 35 U.S.C. 154(b) by 0 days.

(21) Appl. No.: 10/767,747

(22) Filed: Jan. 30, 2004

(65) Prior Publication Data

US 2005/0166307 A1 Aug. 4, 2005

(51) Int. Cl.[7] ..... A47K 11/12
(52) U.S. Cl. ..... 4/144.1; 4/342
(58) Field of Search ..... 4/144.4, 300.3, 4/340–342

(56) References Cited

U.S. PATENT DOCUMENTS 698,419 A * 4/1902 Taylor ..... 4/144.3
2,769,982 A 11/1956 Gossett
3,625,654 A 12/1971 Van Duyne
4,612,676 A 9/1986 Whitman
5,044,020 A 9/1991 Lewandowski et al.
5,148,553 A 9/1992 Jermann
5,388,279 A 2/1995 Rasmussen
5,465,431 A * 11/1995 Wertz ..... 4/300.3
2002/0020006 A1 2/2002 Mason, Jr. et al.

* cited by examiner

*Primary Examiner*—Charles E. Phillips
(74) *Attorney, Agent, or Firm*—Richard C. Litman

(57) ABSTRACT

A clip-on training urinal configured to be clipped onto the rim of a toilet bowl, preferably at the side of the bowl. The training urinal extends downward from the outside of the rim and is in the general shape of a rectangular open-top container having a flat base and an upper open rim. The front wall is cut out to form an opening similar to a urinal which a small boy can reach while standing on the bathroom floor, the opening having a front wall extending down to the base to form a urine reservoir. A side handle is provided to lift the urinal from the toilet bowl rim to empty the urine by pouring it into the toiled bowl.

16 Claims, 5 Drawing Sheets

CLIP-ON TRAINING URINAL

BACKGROUND OF THE INVENTION

1. Field of the Invention

The present invention relates to toilet training devices for children. More particularly, the present invention relates to a training urinal for training small boys to use a urinal.

2. Description of the Related Art

In most homes only a standard ceramic toilet bowl is available for toilet purposes. A small boy is not tall enough to stand and urinate into the typical toilet bowl and must partially undress and climb on the toilet seat to urinate. For very small boys, an adult may be required to assist the boy, taking them away from other endeavors. In public restrooms, floor-length or very low mounted urinals may be available.

It would be desirable to provide a training urinal which may be clipped on an existing toilet bowel rim and depend downward from the rim level so as to be usable by a small boy and serves to train him for using public urinals. Such a urinal would also be useful for daily use while the boy is small, reducing supervision time by an adult. It would also be useful to provide such a training urinal with a handle for easy and sanitary grasp of the urinal by the child or an adult for dumping the collected urine into the toilet bowl. The device is desirably designed with sidewalls such as to avoid splash of urine outside the training urinal. Also, it would be useful if the training urinal had a flat, level base for storing on the floor in a relatively small space and providing an easily reached handle for retrieving the training urinal from the floor and putting it in place on the toilet bowl. The clip-on device is preferably configured so that the toilet seat may be lowered when the training device is hung in place on the toilet bowl.

U.S. Pat. No. 5,148,553, issued Sep. 22, 1992, to Jermann, describes a child's urinal with a bowl and a back wall and which can be hung from the rim of a toilet so that it is close to the floor, allowing a young boy to use it easily. The bottom of the urinal is also flat, allowing it to rest on the floor. The urinal can be easily detached from the toilet and emptied.

U.S. Pat. No. 3,625,654, issued Dec. 7, 1971, to Van Duyne, describes a urine collection device that can be hung from the rim of a toilet so that it hangs either outside or inside the toilet.

U.S. Patent Application Publication No. 2002/020006 A1, for Mason Jr. et al., describes a portable urinal for training young boys, which can be placed on the ground or against any wall and looks like a typical adult urinal.

U.S. Pat. No. 2,769,962, issued Nov. 13, 1956, to Gossett, describes a portable urinal for training young boys, which may be placed for use on the floor and stands upright.

U.S. Pat. No. 4,612,676, issued Sep. 23, 1986, to Whitman, describes a urinal attachment and deflector for a toilet which extends upward from the rim of a toilet bowl for allowing use of the toilet as a urinal by older boys while avoiding splashing on the rim or outside the bowl.

U.S. Pat. No. 5,044,020, issued Sep. 3, 1991, to Lewandowski et al., describes a urinal for training young boys, which attaches to a wall and includes a removable insert, by which the urinal can be emptied without the person emptying it having to come in contact with a portion of the device that has touched the urine.

U.S. Pat. No. 5,388,279, issued Feb. 14, 1995, to Rasmussen describes a urinal for a male toddler which is self-standing an having a urination cavity with a drain to a removable collector cup.

None of the above inventions and patents, taken either singly or in combination, is seen to describe the instant invention as claimed. Thus, a clip-on training urinal solving the aforementioned problems is desired.

SUMMARY OF THE INVENTION

The clip-on training urinal of the present invention is configured to be clipped onto the rim of a toilet bowl, preferably at the side of the bowl. The training urinal extends downward from the outside of the rim and is in the general shape of a rectangular open top container having a flat base and an upper open rim. The outer wall of the urinal has a cutout extending downward between sidewalls, the lower end defined by a horizontal, concave curved rim spaced upward from the flat base so as to form a urine collection reservoir. The curved rim is spaced substantially below the level of the toilet bowl rim, thus allowing a small boy to use the urinal while standing on the floor.

The urinal has sidewalls to keep the urine from splashing outside the urinal. A handle is attached to the upper rim at a sidewall so as to be easily grasped, allowing the urinal to be lifted from the bowl rim and the urine within easily poured in the manner of a pitcher into the toilet and flushed away. The training urinal is then clipped back onto the toilet bowl rim and the seat lowered over the clip.

The training urinal may easily be set aside as the base is flat and horizontal, allowing the training urinal to be stored on the bathroom floor. The training urinal is compact overall and the base is of such size as to provide resistance to overturning. The walls of the training urinal preferably extend slightly outward between the base and the upper rim for an attractive appearance and to aid in the molding of the training urinal. The training urinal is preferably molded of a plastic material. The inventive training urinal is useful both as a device to train a small boy to use a public urinal and as a daily convenience where the parent need not be present to assist. The small boy need not partially undress and climb on the adult-sized toilet with the obvious dangers attendant thereto.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a clip-on training urinal configured to be clipped onto the rim of a toilet bowl, preferably at the side of the bowl. The training urinal extends downward from the outside of the rim and is in the general shape of a rectangular open-top container having a flat base and an upper open rim. The front wall is cut out to form an opening similar to a urinal which a small boy can reach while standing on the bathroom floor, the opening having a front wall extending down to the base to form a urine reservoir. A side handle is provided to lift the urinal from the toilet bowl rim to empty the urine by pouring it into the toilet bowl.

Figure 5:
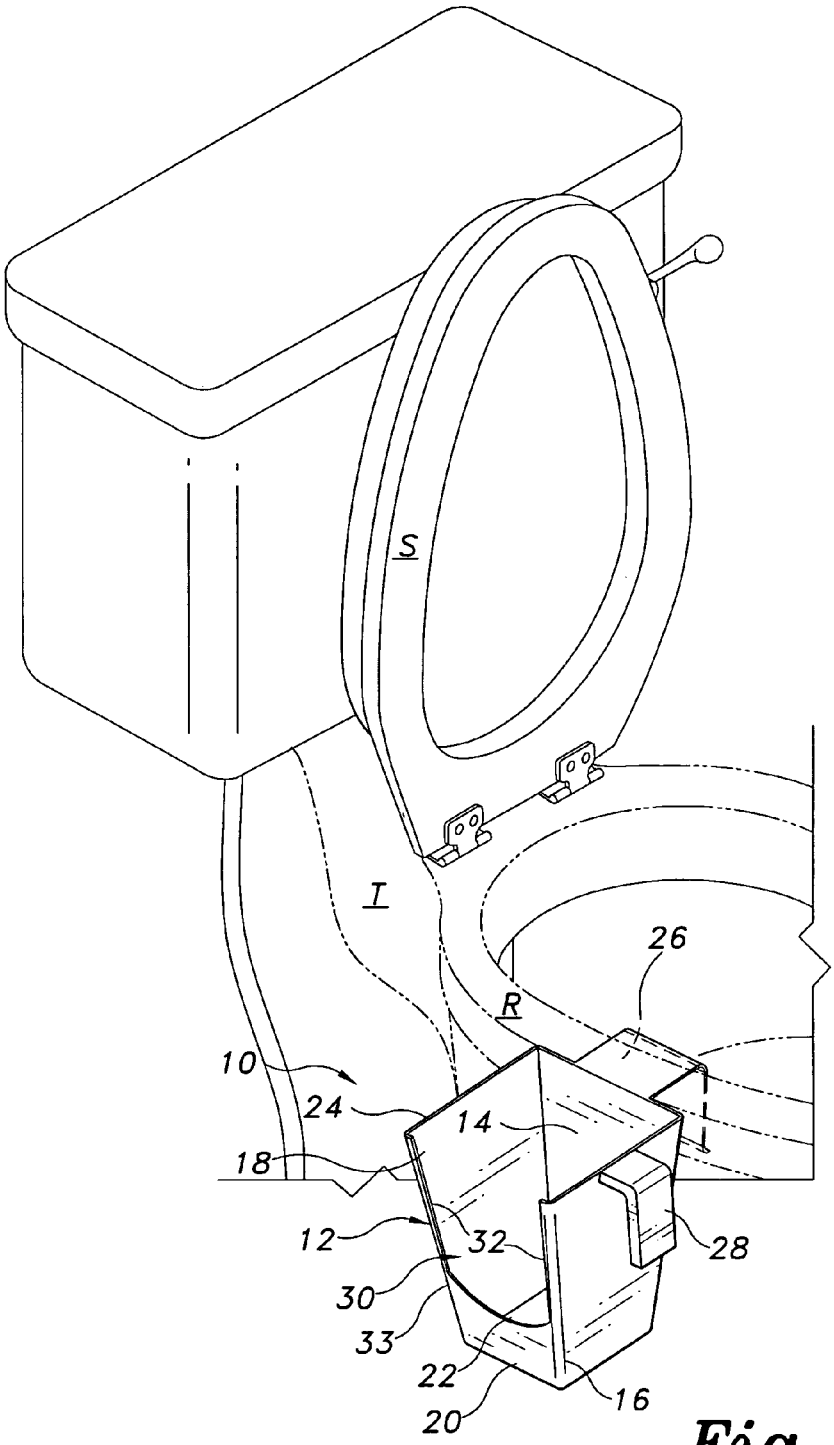
FIG. 5 is an environmental, perspective view of a clip-on training urinal as in FIG. 1 with the toilet seat in the raised position.

Referring to the Figures, clip-on training urinal 10 is a generally rectangular open container 12 located on the side of a toilet T having a ceramic bowl C having a rim R (see FIG. 5) and a toilet seat S. Training urinal 10 includes an open container 12 having a rear wall 14, a first sidewall 16, a second sidewall 18 and a front wall 20 and is closed at its lower end by horizontal base 22. Walls 14, 16, 18, and 20 connect at respective corners and extend upward to form an upper rim 24. A clip 26 extends rearwardly from the back wall 14 at the center of the back portion of rim 24 and hooks rearwardly over bowl rim R so as to support container 12 on rim R, the container 12 extending downward from the bowl rim R to a point above the bathroom floor on which toilet T is installed. A handle 28 extends laterally from the first sidewall 16 at the center of the first sidewall portion of rim 24 and may be in the general shape of a downward-opening hook.

A front wall opening 30 for urination is in the general shape of a urinal and is defined by front wall 20 extending slightly inward from and parallel to and proximate the respective corners of sidewalls 16 and 18, opening 30 extending downward from upper rim 24, the lower central portion of front wall 20 extending upward from base 22 defining the lower end of opening 30. The front wall 20 forms a concave curved lower rim 33 at the lower end of opening 30 at an appropriate height for a small boy to reach for urinating through opening 30 while standing on the bathroom floor. The wall 20 extends upward from base 22 to the lowest point of rim 33, and, along with walls 14, 16, and 18, form a reservoir for retaining the urine.

Figure 1:
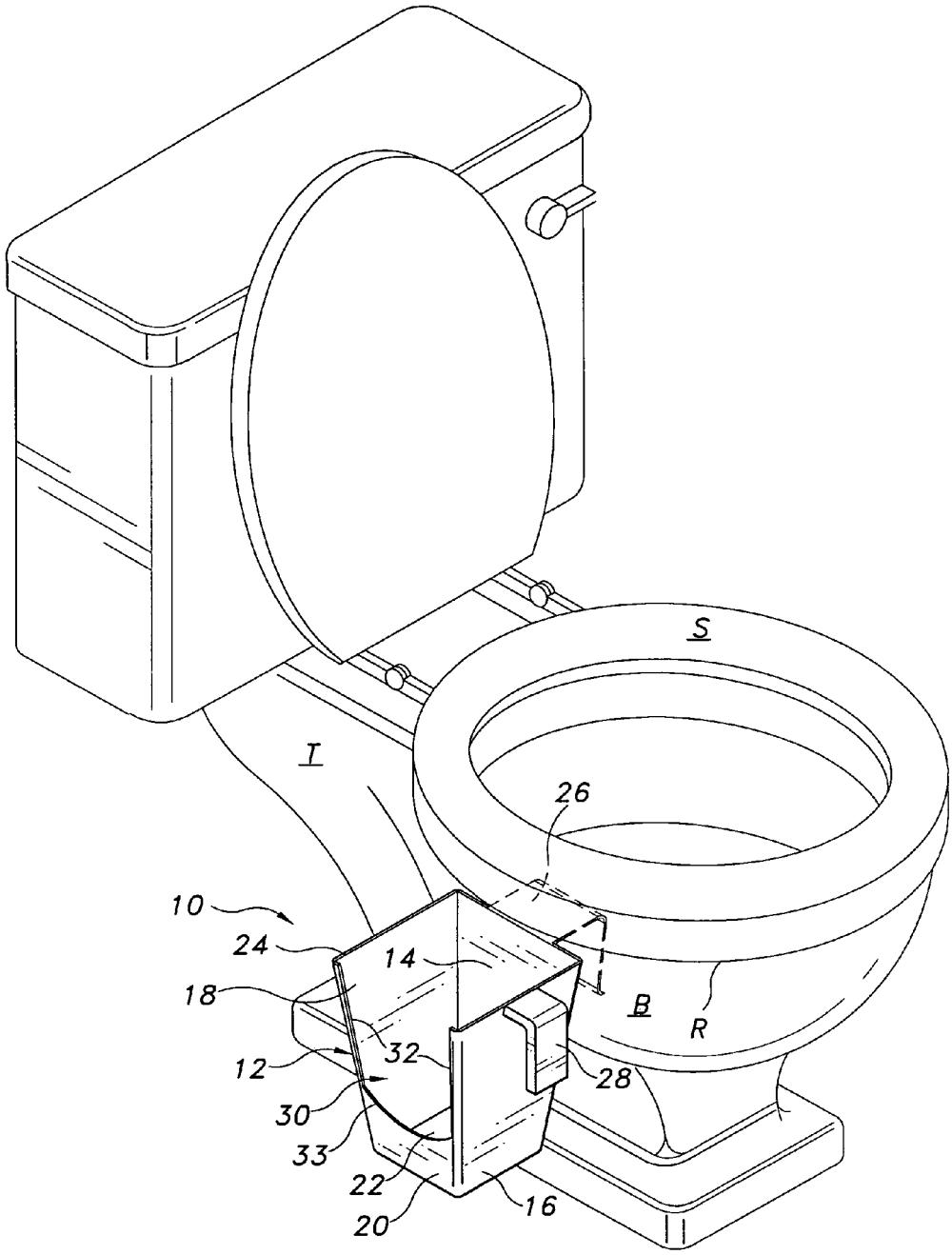
FIG. 1 is an environmental, perspective view of a clip-on training urinal according to the present invention.
Figure 2:
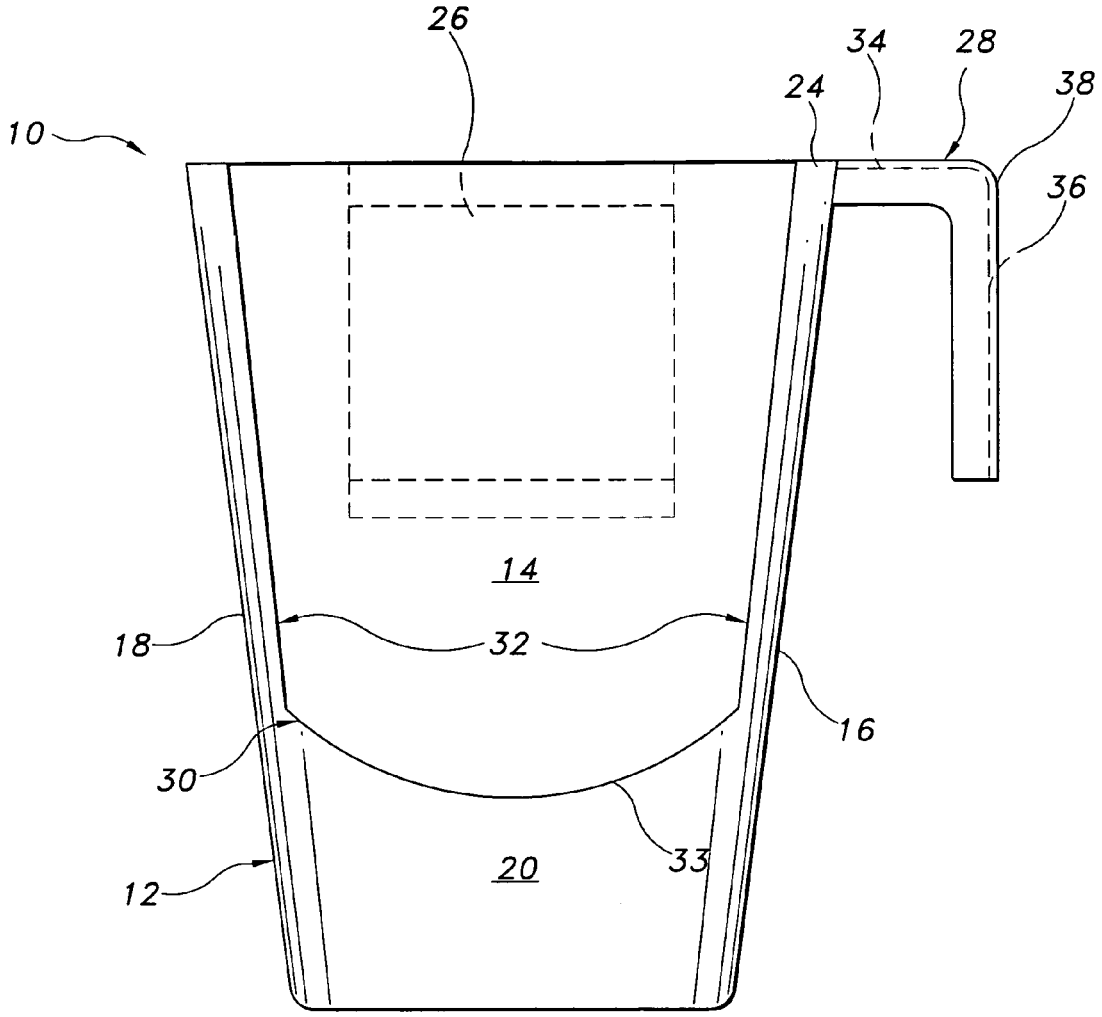
FIG. 2 is a side elevation view of a first side of the training urinal of FIG. 1.

As seen in FIG. 2, handle 28 is in the general shape of a downward-opening hook and includes a horizontal handle portion 34 and a depending handle portion 36 depending from the outer end 38 of horizontal portion 34. Horizontal handle portion 34 preferably extends laterally outward from first wall 16 at upper rim 24. The portions of handle 28 are preferably of "U"-shaped construction, opening downward and inward, providing sidewalls for easy grasping while minimizing the amount of material required in its construction. Handle 28 may be similarly attached to second wall 18 as desired.

Figure 3:
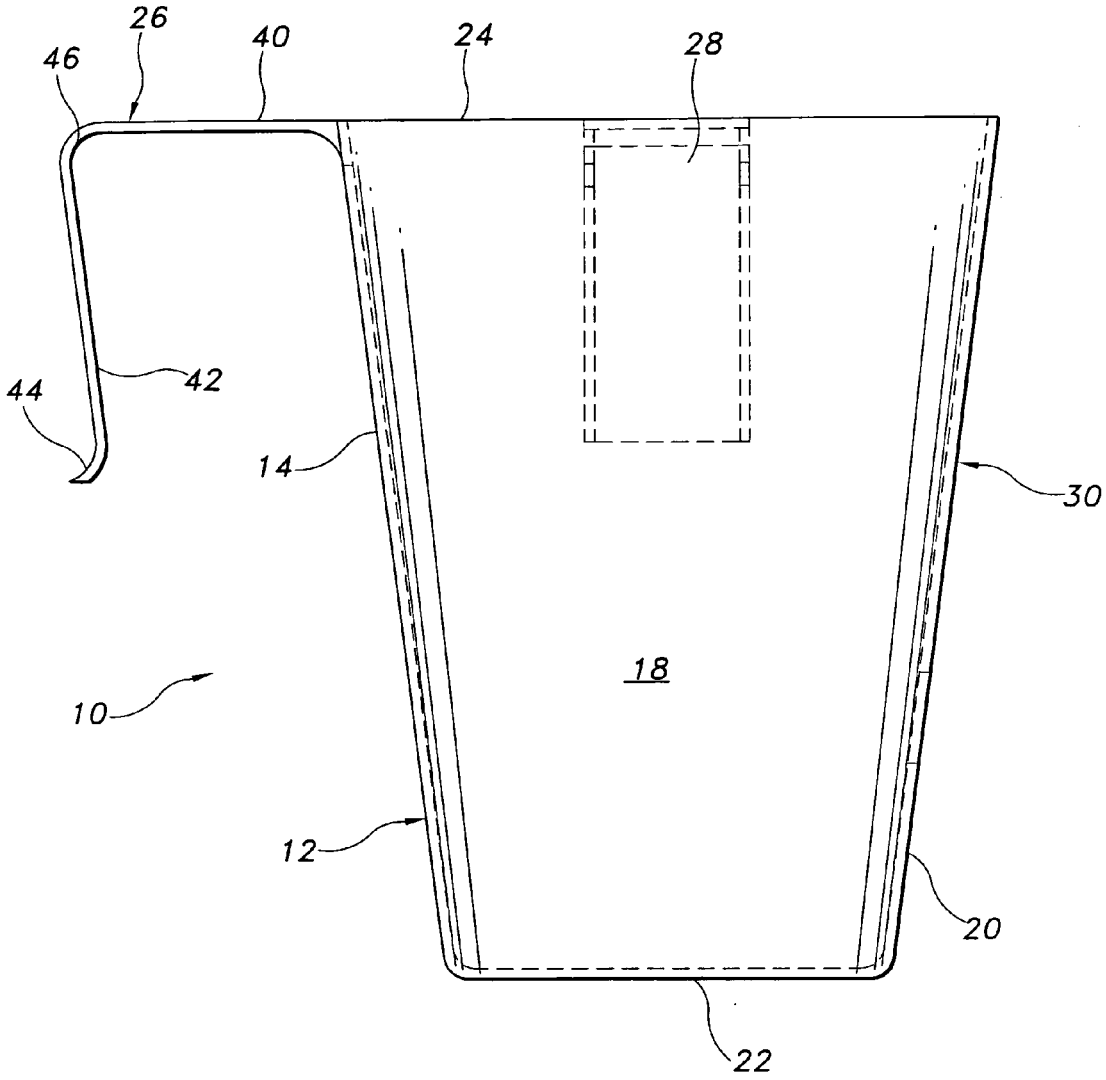
FIG. 3 is a side elevation view of a second side of the training urinal of FIG. 1.

As seen in FIG. 3, clip 26 is in the general shape of a downward-opening hook and extends rearwardly of the open container 12 so as to extend over the rim R of the toilet bowl B. Clip 26 includes a horizontal portion 40 and a depending portion 42 having an outward flare 44 at its lower end to ease engagement with the rim R. Horizontal clip portion 40 extends rearwardly from back wall 14 at upper rim 24 to a rear downward hook bend 46 from which depending hook portion 42 extends.

Figure 4:
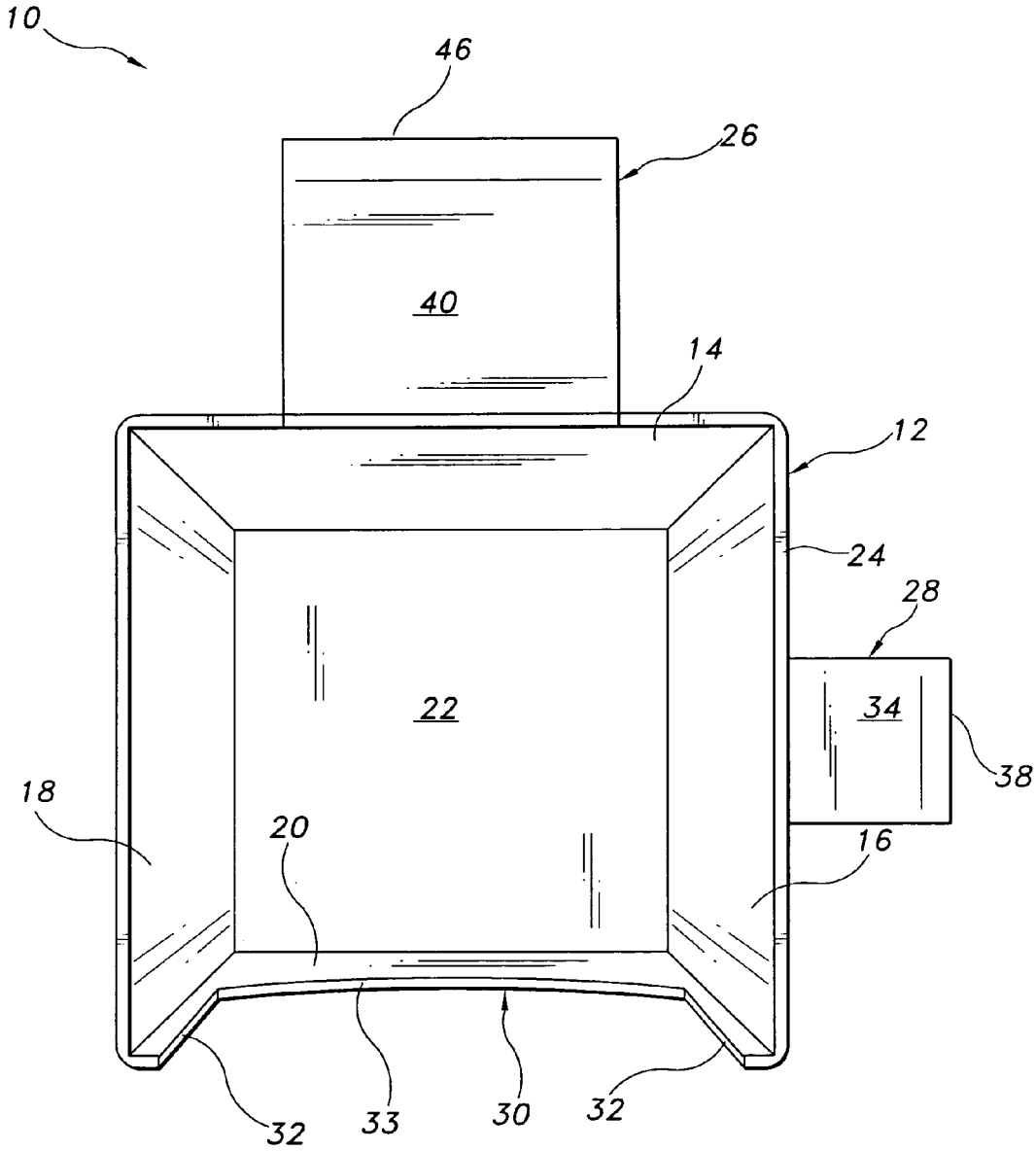
FIG. 4 is a plan view of the training urinal of FIG. 1.

As seen in the Figures and particularly FIG. 4, the walls of generally rectangular container 12 preferably flare out slightly from base 22 to upper rim 24 for aesthetic reasons and to simplify molding of the training urinal 10 from plastic material. The corners formed by the walls are preferably rounded, as shown, for similar reasons.

In use, the clip-on training urinal 10 is mounted over the rim R of a toilet bowl B by means of clip 26. The training urinal 10 extends downward from the rim and defines the opening 30 in front wall 20. Once the small boy urinates into the training urinal 10, an adult lifts the seat S (see FIG. 5) and grasps handle 28, lifting the urinal upward from rim R. The urine may then be emptied into the toilet bowl by tipping the urinal by means of the handle and pouring the contents therein. The toilet T may then be flushed and the training urinal returned to its position clipped to the rim R for re-use. The seat S may then be lowered to its rest position.

The container 12 is preferably about 8" in height by about 6" in width by about 6" in depth at the rim 24. The clip 26 is about 3" in width and extends about 2½" rearward with a bend and extending downward and slightly inward for about 3". The base 22 of the container is about 4" in width by 4" in depth. The urination opening 30 is about 6½ inches in height by 5½ inches in width to allow easy urination by a small by. Handle 28 is about 2" wide and protrudes laterally from the right side at rim 24 about 2" and then extends down about 3". The handle may be "U"-shaped in cross section, providing sidewalls for easy grasping while minimizing the amount of plastic material required. The thickness of the various parts of the container is about 0.10".

The clip-on training urinal is preferably molded from plastic material but may be constructed of any desired material such as metal. The plastic may be selected in a large variety of colors to match any bathroom decor. The handle may be mounted on either side of the urinal as desired.

It is to be understood that the present invention is not limited to the embodiments described above, but encompasses any and all embodiments within the scope of the following claims.

We claim:

1. A clip-on training urinal, comprising:

a generally rectangular open container having a horizontal base and a wall extending upward from said horizontal base, said wall having an upper rim and including a rear wall, a first sidewall, an opposing second sidewall, and a front wall having connecting corners therebetween;

a clip extending rearwardly from said rear wall proximate said rim, said clip being configured to fit over the rim of a conventional toilet bowl and suspend said container downward, outside the toilet bowl;

a handle extending laterally from said first sidewall proximate said rim, wherein said handle is spaced along said rim from said clip;

said front wall defining an opening for urination extending downward from said upper rim and ending in a lower rim;

said lower rim being spaced above said base and defining a reservoir of at least sufficient volume to contain the liquid resulting from the urination from a small boy;

whereby the small boy may urinate through said opening for urination and said container may then be grasped at said handle and lifted from the toilet bowl rim, the urine therein poured into the toilet by tilting the container so as to empty said reservoir, and said container returned to said toilet bowl rim and suspended therefrom by said clip.

2. The training urinal of claim 1, wherein said clip is in the configuration of a downward-opening hook, said clip having an upper horizontal hook portion extending rearward from said rear wall rim and a depending hook portion connected by a bend, said depending hook portion having a lower end.

3. The training urinal of claim 2, wherein said clip extends from about the center of said rear wall rim, and said lower end of said depending hook portion forms a rearward bend.

4. The training urinal of claim 3, wherein said handle is in the configuration of a downward-opening hook, said handle having an upper horizontal hook portion extending laterally from said first wall rim and having an outer end and a generally vertical depending hook portion connected at said outer end.

5. The training urinal of claim 1, wherein said urination opening extends downward from said rim, and has generally vertical sides, said sides being generally parallel to the respective corners between said front wall and said first and second sidewalls, said lower rim being in the shape of a horizontal concave curve.

6. The training urinal of claim 5, wherein said generally vertical sides of said urination opening are proximate said corners.

7. The training urinal of claim 6, wherein said walls flare upwardly and outwardly to said rim.

8. A clip-on training urinal, comprising:

an open container having a horizontal base and a wall extending upward from said horizontal base, said wall having an upper rim, said open container being generally rectangular in shape, said wall comprising a rear wall, a first sidewall, an opposing second sidewall, and a front wall having connecting corners therebetween, said opening for urination being defined by said front wall;

a clip extending outward rearwardly from said rear wall proximate said rim, said clip being configured to fit over the rim of a conventional toilet bowl and suspend said container downward, outside the toilet bowl;

a handle attached to said wall proximate said rim, said handle being spaced along said rim from said clip, said handle extending laterally from said first sidewall;

said wall defining an opening for urination extending downward from said upper rim and ending in a lower rim;

said lower rim being spaced above said base and defining a reservoir of at least sufficient volume to contain the liquid resulting from the urination from a small boy;

whereby the small boy may urinate through said opening for urination and said container may then be grasped at said handle and lifted from the toilet bowl rim, the urine therein poured into the toilet by tilting the container along said second sidewall so as to empty said reservoir, and said container returned to said toilet bowl rim and suspended therefrom by said clip.

9. The training urinal of claim 8, wherein said clip is in the configuration of a downward-opening hook, said clip having an upper horizontal hook portion extending rearward from said rear wall rim and a depending hook portion connected by a bend, said depending hook portion having a lower end.

10. The training urinal of claim 9, wherein said clip extends from about the center of said rear wall rim, and said lower end of said depending hook portion forms a rearward bend.

11. The training urinal of claim 10, wherein said handle is in the configuration of a downward-opening hook, said handle having an upper horizontal hook portion extending laterally from said first wall rim and having an outer end and a generally vertical depending hook portion connected at said outer end.

12. The training urinal of claim 8, wherein said urination opening is defined by said front wall.

13. The training urinal of claim 12, wherein said urination opening extends downward from said rim, and has generally vertical sides, said sides being generally parallel to the respective corners between said front wall and said first and second sidewalls, said lower rim being in the shape of a horizontal concave curve.

14. The training urinal of claim 13, wherein said generally vertical sides of said urination opening are proximate said corners.

15. The training urinal of claim 14, wherein said walls flare upwardly and outwardly to said rim.

16. A clip-on training urinal, comprising:

an open container having a horizontal base and a wall extending upward from said horizontal base, said wall having an upper rim, said open container being generally rectangular in shape, said wall comprising a rear wall, a first sidewall, an opposing second sidewall, and a front wall having connecting corners herebetween, said opening for urination being defined by said front wall;

a clip extending outward rearwardly from said rear wall proximate said rim, said clip being configured to fit over the rim of a conventional toilet bowl and suspend said container downward, outside the toilet bowl;

a handle attached to said wall proximate said rim, said handle being spaced along said rim from said clip, said handle extending laterally from said first sidewall;

said front wall defining an opening for urination extending downward from said upper rim and ending in a lower rim;

said lower rim being spaced above said base and defining a reservoir of at least sufficient volume to contain the liquid resulting from the urination from a small boy;

said urination opening having generally vertical sides, said sides being generally parallel to the respective corners between said front wall and said first and second sidewalls, said lower rim being in the shape of a horizontal concave curve;

said generally vertical sides of said urination opening being proximate said corners;

whereby the small boy may urinate through said opening for urination and said container may then be grasped at said handle and lifted from the toilet bowl rim, the urine therein poured into the toilet by tilting the container along said second sidewall so as to empty said reservoir, and said container returned to said toilet bowl rim and suspended therefrom by said clip.

* * * * *